US006994149B2

(12) United States Patent
Cloostermans

(10) Patent No.: US 6,994,149 B2
(45) Date of Patent: Feb. 7, 2006

(54) CASTING SYSTEM AND METHOD FOR POURING NONFERROUS METAL MOLTEN MASSES

(75) Inventor: Leon Raphael Lucienne G. Cloostermans, Maarkedal (BE)

(73) Assignee: Hof Te Fiennes N.V., Maarkedal (BE)

( * ) Notice: Subject to any disclaimer, the term of this patent is extended or adjusted under 35 U.S.C. 154(b) by 3 days.

(21) Appl. No.: 10/888,714

(22) Filed: Jul. 8, 2004

(65) Prior Publication Data

US 2005/0022961 A1 Feb. 3, 2005

(30) Foreign Application Priority Data

Aug. 1, 2003 (EP) ..... 03017412

(51) Int. Cl.
*B22D 11/10* (2006.01)

(52) U.S. Cl. ..... 164/437; 164/434; 164/440; 222/591

(58) Field of Classification Search ..... 164/434, 164/437, 438, 440, 490, 488; 222/606, 607, 222/591

See application file for complete search history.

(56) References Cited

U.S. PATENT DOCUMENTS

| | | | | |
|---|---|---|---|---|
| 3,036,348 A | | 5/1962 | Hazelett et al. | |
| 4,544,018 A | | 10/1985 | Figge et al. | |
| 4,819,840 A | * | 4/1989 | Lax et al. | 222/606 |
| 4,949,778 A | * | 8/1990 | Saito et al. | 164/468 |
| 5,000,250 A | | 3/1991 | Feuerstacke | |
| 5,871,660 A | * | 2/1999 | Xu et al. | 222/594 |
| 5,992,711 A | * | 11/1999 | Mochizuki et al. | 222/606 |
| 6,321,953 B1 | * | 11/2001 | Nakamura et al. | 222/590 |

FOREIGN PATENT DOCUMENTS

| | | |
|---|---|---|
| DE | 40 34 652 A1 | 5/1992 |
| DE | 197 38 385 C2 | 3/1999 |
| DE | 101 13 026 A1 | 10/2002 |
| EP | 0 194 327 A1 | 9/1986 |
| EP | 0 925 132 B1 | 6/1999 |

* cited by examiner

*Primary Examiner*—Len Tran
(74) *Attorney, Agent, or Firm*—Laurence A. Greenberg; Werner H. Stemer; Ralph E. Locher

(57) ABSTRACT

A casting system for pouring nonferrous metal molten masses, in particular copper or copper alloys, has a tundish and a submerged pipe feeding into a molten bath inside a thin-slab mold. Trouble-free discharge of the melt into the mold and degassing at the exposed surface of the mold is ensured. The submerged pipe leading from the tundish along a pre-defined pouring angle has first and second sections. The latter is a tip nozzle that submerses into the molten bath. It has at its wall facing the mold bottom one or more discharge openings effecting a change in the flow direction of the molten mass. A lip at the tip nozzle is spaced so as to overlap the discharge opening, to cause a second flow direction change and lateral distribution. The discharge opening and the lip are disposed inside the mold bath, below a bath surface, during operation.

16 Claims, 7 Drawing Sheets

CASTING SYSTEM AND METHOD FOR POURING NONFERROUS METAL MOLTEN MASSES

BACKGROUND OF THE INVENTION

Field of the Invention

The present invention relates to a casting system for the pouring of nonferrous metal melts, in particular copper or copper alloys, for the manufacture of slab-type products. The system has a tundish with at least one submerged pipe, preferably in an inclined disposition, that submerges into a molten bath inside a thin-slab mold. The invention further pertains to a pouring method.

Submerged pouring pipes for discharging molten metal into a mold are well-known in various styles and designs. Submerged pouring pipes are intended to ensure an even and turbulence-free distribution of molten metal inside the mold. Also, the use of submerged pipes is meant to prevent oxygen in the air from coming in contact with the metal flow underneath the bath surface. Caused by the hydrostatic pressure in the tundish the molten mass is accelerated to the required flow rate, and the flow rate as such increases as a function of the pouring angle. In practice, submerged pouring pipe applications show that with increasing acceleration a negative pressure builds up in the submerged pipe which creates turbulent movements in the melt inside the mold and, as a consequence, causes bath level fluctuations. In addition, the casting of metal masses, in particular if copper or copper alloy is involved, is accompanied by a number of chemical and physical processes, including most intensive interaction between the gaseous and solid component parts of the melt. These boundary conditions or constraints are influenced, among other things, by the temperature gradient and the pressure of the molten mass. Negative pressures, as they may build up in the submerged pouring pipe, can lead to a release of the gaseous substances, such as hydrogen, sulphur dioxide, contained in the melt. In case of release of gases there is the risk that porous areas develop when the melt solidifies, which will diminish the quality of the finished product.

To prevent negative streaming pressures to build up in the pouring pipe, German published patent application DE 40 34 652 A1 suggests the cross-section at the inlet end of the pouring pipe, by installing a throat, to be kept smaller than the cross section of the effective area of flow at the discharge end, with a view to building up in the molten stream a pressure higher than the atmospheric pressure. The outlet of the metallurgic vessel and the pouring pipe are connected to each other by a conical set of seals.

German patent DE 197 38 385 C2 describes an submerged pouring pipe which has at its lower end a bottom element together with at least two lateral discharge openings arranged above the bottom element. The internal wall of the submerged pipe is equipped with special flow-guiding elements.

From German published patent application DE 101 13 026 A1, there is known a submerged pouring pipe with a funnel-type swirl chamber arranged at the end of the pipe, with a stalled edge provided at the part connecting pipe section with a swirl chamber.

European patent EP 0.925 132 B1, describes a submerged pouring pipe for continuous casting of thin slabs where the pipe as such, with a circular cross section, is arranged in vertical position connected with the foundry ladle. The pouring pipe has at its lower end a flattened distribution section, a so-called diffuser, to submerge into the molten mass in the mold. Inside the diffuser there is a separation body tapering in flow direction so as to form two part streams. The diffuser's cross section above the separating body is smaller than the cross section of the upper section of the pouring pipe.

The side walls of the diffuser diverge outwards at the same angle as the side walls of the separating body diverge inwards. This design is meant to prevent turbulences and other whirling motion in the bath surface. The disadvantage in this arrangement is that the stream of molten mass is still discharged deep into the mold bath and, hence, degassing takes place in the internal areas of the mold bath. Submerged pouring pipes as are known from the state of the art described above are designed for use in vertical pouring, in particular of steel melts, for relatively thick slabs. The stream of molten material is injected in vertical direction, i.e. on the shortest possible way into the mold bath. As a rule, the stream is left undisturbed by technical means until short before entering the mold bath.

SUMMARY OF THE INVENTION

It is accordingly an object of the invention to provide a method and a system of casting a non-ferrous melt which overcomes the above-mentioned disadvantages of the heretofore-known devices and methods of this general type and which provides a casting system for pouring nonferrous metal molten masses, in particular copper or copper alloys, that ensures a trouble-free injection of the melt into the mold together with the degassing to take place at the exposed surface of the mold, which prevents negative pressures from building up in the submerged pipe, and which is further distinguished by a simple structural design. It is a further object to provide a suitable method for pouring nonferrous metal molten masses.

With the foregoing and other objects in view there is provided, in accordance with the invention, a casting system for pouring nonferrous metal melt, in particular copper or copper alloy. The system comprises:

a tundish and at least one submerged pipe communicating with the tundish and extending at an incline with a pre-defined pouring angle towards and into a mold;

the submerged pipe having a first section and a second section defining a tip nozzle for submersion into a molten bath in the mold, whereby the tip nozzle is sealed off at a free end thereof, the second section having a wall facing a bottom side of the mold formed with at least one discharge opening and configured to effect a first change in a flow direction of a molten mass through the submerged pipe; and a lip disposed at the tip nozzle, overlapping the discharge opening at a pre-defined distance, and causing the molten mass to experience a second change in the flow direction and distribution transversely to a longitudinal axis of the mold, and the discharge opening together with the lip being located below a mold bath surface in an operating state thereof.

The novel casting system is configured so as to allow the molten mass in the tundish to flow, preferably in a sloping way, downwards in into the mold that is placed at a geodetically lower level.

The pouring angle can be from 2° to 90°. At the front side of the tundish, as seen in discharge direction, there is at least one submerged pipe sloping downward at the specified pouring angle. In order to be able to pour slab-type products of a wider size, i.e. the width of which is greater or equal 1.5 H (H being the height or the thickness, respectively), the tundish may be equipped with more than one submerged pipe, all of them being of identical design and incorporated one next to the other at a specified spacing.

The submerged pipe comprises a first section with its internal walls gradually narrowing in flow direction of the molten mass, and a second section forming the submerged pipe's tip nozzle. The internal wall of the first section has not necessarily to be of a tapering shape but can have other suitable geometrical forms. In case of need, there can be a short tubular connecting piece right at the and of the first section before the latter is changing over to the throat. This connecting piece, or the starting piece of the first section is cast-in into an insert made of refractory concrete arranged in the tundish. The first section, starting at the tundish, extends as far as the very surface of the mold bath. Caused by the throat, the cross section changes to a smaller effective area. Tapering can be achieved on different ways. Starting with a circular cross section at the beginning of this section, the pipe may be squeezed, for example, into a flat shape where the cross-sectional area at the end of this section appears to be a long hole. Such re-forming may be-done in a way by which the cross-sectional area at the end of the section has an elliptical shape, or the entire section may be formed to taper in a hexagonal style. In another version this section may be formed in a conical shape. This section is followed by the submerged pipe's tip nozzle that submerges into the bath of molten mass inside the mold. At its free end, the tip nozzle is sealed off, e.g. by a plug. At its wall facing the bottom side of mold, the tip nozzle has at least on discharge opening which, in operating state, is situated in the mold bath in a subsurface position and as such causes the stream of molten mass to undergo a first deflection.

The submerged pipe may be made as a whole from one single pipe section where the tip nozzle of the submerged pipe may be reformed in the same way as the upstream pipe section so as to have at its end an elliptical or circular cross-sectional area, or a cross-sectional area in the shape of a oblong hole. Hence, the shape of the cross-sectional area, seen over the overall length of the tip nozzle of the submerged pipe, does change only slightly.

Another option is to configure the tip nozzle as a separate component that has an almost constant or tapering cross-sectional area, and to attach the separate component to the re-formed section, for example, by welding. In such case it is possible to build the section in a conical shape and attach to it the submerged pipe's tip nozzle that is shaped as a long hole, with the submerged pipe's tip nozzle being provided with a short transition piece to connect the circular cross section with the long-hole one. The submerged pipe's tip nozzle when built as a separate component may be made of any heat-resistant material other than used for the tapering section.

If the tip nozzle cross section is shaped as an oblong hole the distance between the two opposite parallel wall sections, should be at least one third of the cross-sectional diameter as determined at the beginning of the tapering section of the submerged pipe.

The discharge opening, through which the molten mass may flow out, provided at the bottom part of the tip nozzle is preferably formed in oblong hole shape. Instead of such an oblong hole, there may be two circular openings placed right behind each other.

As the first section of the submerged pipe has a gradually narrowing cross section the melt is kept in constant contact with the internal walls of the submerged pipe so as not to allow any air bubbles or caves to be formed inside the submerged pipe. Length and grade of tapering in this section is dependent of the properties of the molten mass and the pouring angle selected. Submerged pipes are of constant wall thickness.

As the tip nozzle is sealed off and the molten mass is not allowed to flow out there in axial direction, the stream of molten mass, when approaching the discharge opening(s), undergoes a first deflection by at least 90° in relation to the pouring angle. This change of direction which is forced upon the stream of molten mass is of importance as this will ensure the molten mass is discharged into the mold as gently as possible. Preferably, cross-sectional area of the discharge opening, or the total of the cross-sectional areas of all discharge openings involved should be from 80% to 98% of the cross-sectional area as measured at the end of the tip nozzle.

In certain applications, this value can be even greater than 100%. The cross-sectional areas of the discharge openings may be of different shapes. In operating conditions, the submerged pipe is completely filled up with molten mass which, over the entire pouring process, is not allowed to get out of contact with the submerged pipe's internal walls. This in turn rules out the risk of negative pressures to build up so as to not allow any unwanted degassing to occur in the melt. By the deflection, or change of direction of the stream of molten mass as provided when entering the molten bath a so-called "shooting" of molten mass is avoided and, hence, excessive formation of bubbles is prevented.

As another important feature there is a lip spaced out underneath the discharge opening(s) from where the lip is overlapping the opening(s) by which the stream of molten mass is forced into a second change of direction. The lip is sized so as to provide an impact area equal or greater than that of the discharge opening. The lip is arranged parallel or slanted to the discharge opening in a pre-defined distance which preferably should be at least 5 mm. In case of slanted arrangement the greatest distance should be at least 5 mm. In operating state, both the discharge openings and the lip are found in the molten bath inside the mold in a subsurface position.

The molten mass that flows out from the discharge opening streams, in a first step, flows against the lip where it is slowed down, and is again deflected by at least 90° so as to be distributed in lateral direction in the molten bath. The said second change of direction makes the insertion of melt into the mold to be in a most gentle way. Parting the molten mass when flowing against the lip into two part streams leaving in lateral direction favors possibly still existing bubbles wandering up to the molten bath surface in the mold. Practical tests showed that the above measures make it possible to reduce the flow rate of the molten mass at the entrance into the molten bath to a speed equal or less than 0.5 meters per second.

With the above and other objects in view there is also provided, in accordance with the invention, a method for pouring nonferrous metal molten mass, such as copper or copper alloy melt. The method comprises:

guiding the metal melt from a tundish, through a submerged pipe that extends at a pre-defined pouring angle, and into a molten bath of a mold;

significantly reducing an increasing flow rate of the molten mass by effecting at least two changes in a flow direction of the molten mass, by twice deflecting a flow of the molten mass with at least 90° deflections, and in a subsurface region inside the molten bath of the mold.

In other words, it is primarily important that the flow rate of molten mass, which increases as a function of the pouring angle, is reduced inside the submerged pipe and slowed down before being injected into the molten bath in the mold. Also, the direction of flow of the stream of molten mass is deflected at least twice by at least 90°.

This combination of twice changing the direction of flow of the stream of molten mass-before it is discharged into the molten bath results in a significant reduction of the flow rate, being approximately 50%.

Due to the lateral—transversely relative to the longitudinal axis of the mold—discharge of melt separated into two part streams, the melt situated near the mold walls is constantly kept in contact with fresh hot molten masses and, as a consequence, cannot form surface films of solidified material. Furthermore, hot molten masses are prevented from flowing straight against the mold's internal walls. Gas bubbles possibly still contained are allowed to escape right at the mold's internal walls.

The measures according to this invention lead to a significantly improved microstructure of the semi-finished products that are being manufactured. Undesirable gas or air inclusions are avoided. Due to the repeated change in the direction of flow of the stream of molten mass before it is discharged into the molten bath, which results in a significant reduction of the flow rate, damages to the mold's internal walls are avoided to a very large extent.

The tapering section as well as the tip nozzle of the submerged pipe are made preferably from one and the same heat-resistant material but can also be made from different materials such as, for example, a combination of ceramic and metal. For start-up purposes it may be advantageous to have the submerged pipe equipped with an additional heating assembly, e.g. a resistance heating.

The proposed casting system can be used for pouring thin-walled strips of nonferrous metal, in particular copper or copper alloy, achieving superior quality levels.

In a vertical configuration of submerged pipes the tip nozzles of the submerged pipes have at least two discharge openings on opposite sides, either of which is overlapped by a spaced lip so as to twice deflecting the stream of molten mass by at least 90°, and reducing its flow rate significantly before discharging the molten mass into the mold bath.

Once more in summary, starting from the disadvantages of the prior art, a casting system is created that guarantees a trouble-free discharge of the molten mass into the mold as well as its degassing at the exposed surface of the mold. The solution provided herein is a casting system consisting of a tundish with at least one submerged pipe attached to the same, preferably in an inclined arrangement at a pre-defined pouring angle, with a first section and a second section comprising the tip nozzle of the submerged pipe to submerge into the molten bath inside a mold. The tip nozzle of the submerged pipe is sealed off at its free end has at its wall facing the mold's bottom side at least one discharge opening to effect a first change in the direction of flow of the stream of molten mass. At the tip nozzle of the submerged pipe there is a lip spaced out so as to overlap the discharge opening which leads to a second change of the direction of flow of the stream of molten mass together with its lateral distribution seen from the mold's longitudinal axis, with both the discharge opening and the lip in operating state being situated inside the mold bath in a subsurface position.

Other features which are considered as characteristic for the invention are set forth in the appended claims.

Although the invention is illustrated and described herein as embodied in a casting system and method for pouring nonferrous metal molten masses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
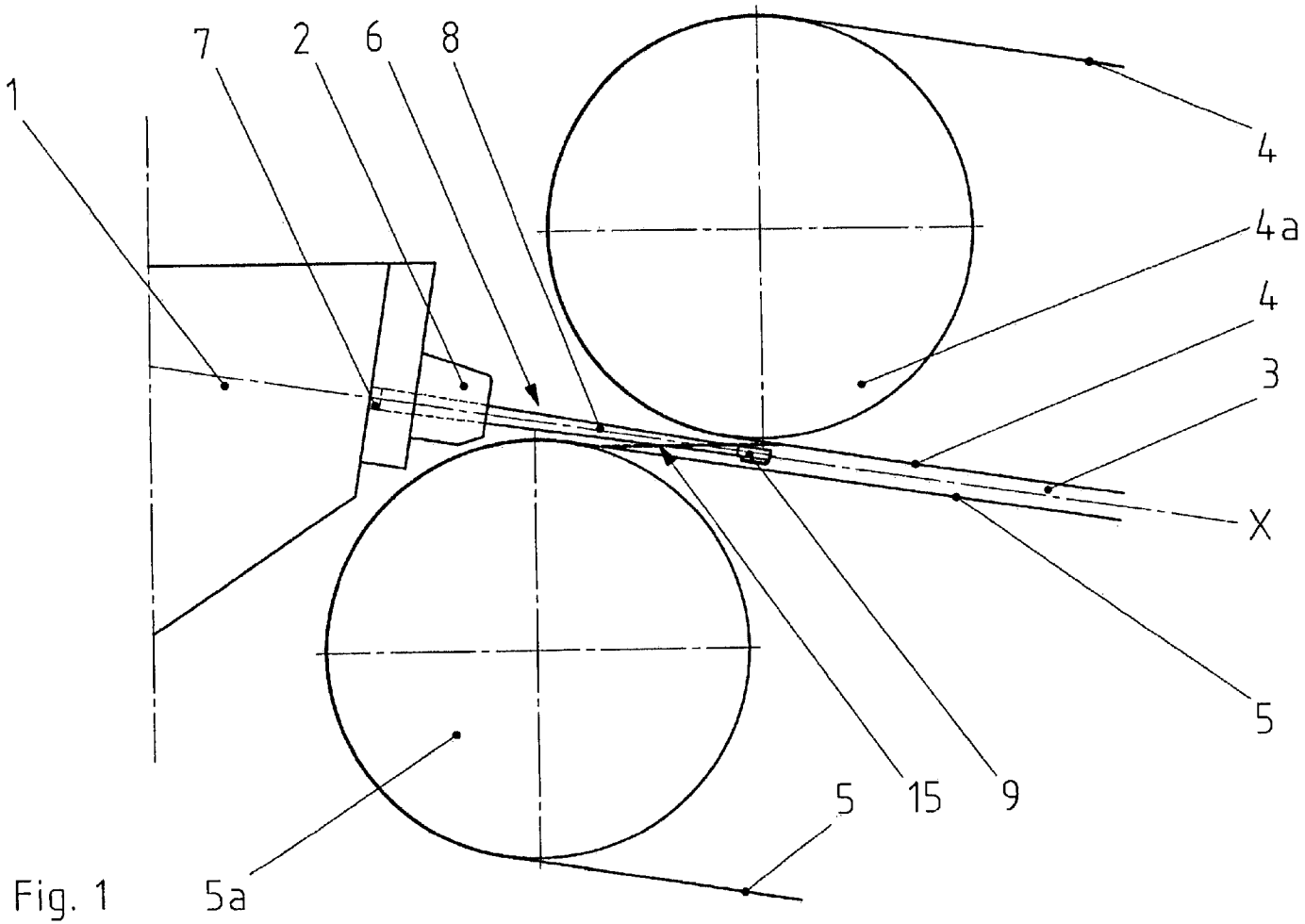
FIG. 1 is a simplified view of a longitudinal section through a casting system according to the invention.

Referring now to the figures of the drawing in detail and first, particularly, to FIG. 1 thereof, there is shown a casting system for pouring copper strips using a mold for continuous casting, also known as "casting with traveling mold." After the copper is melted, the molten mass run from the melting furnace into the tundish 1 which, in this example, is equipped with a casting snout 2. Depending on the width of the strip to be poured the casting snout 2 may have several identical submerged pipes 6, e.g. 6, 8, or 10, arranged next to each other in a pre-defined pouring angle of approx. 10°. The individual submerged pipes' 6 spacing can vary. The view in FIG. 1 shows only one submerged pipe 6. The submerged pipes 6 have cylindrical connecting pieces 7 (cf. FIG. 2) that are cast-in into an insert made of refractory concrete that forms part of the tundish 1. The mold 3 is located between the traveling mold top band 4 and the traveling mold bottom band 5 which are both tensioned using deflection pulleys and driving rollers. FIG. 1 only shows the two deflection front pulleys 4*a*, 5*a*. Also, the mold's side and rear walls, which can be as high as 70 mm, are not to be seen in that drawing. The casting system is integral part of a unit for continuous manufacture of copper strips. The line marked with an "X" is the longitudinal centre axis of mold 3. The molten copper contained in the tundish 1 flows, forced by the inherent hydrostatic pressure, through the submerged pipes 6 into the mold 3. The flow rate of the molten copper is influenced by the inclined arrangement of the submerged pipes 6 and the predetermined pouring angle as is required by the process.

Right after the relatively short connecting piece 7 with circular cross section there begins the submerged pipe's 6 section 8 that gradually narrows in flow direction and extends from the casting snout 2 as far as a bath surface 15 in the mold 3. In the operating position, the front part of the submerged pipe 6, that is the tip nozzle 9 of the submerged pipe, completely submerges into the molten bath in the mold 3.

Figure 2:
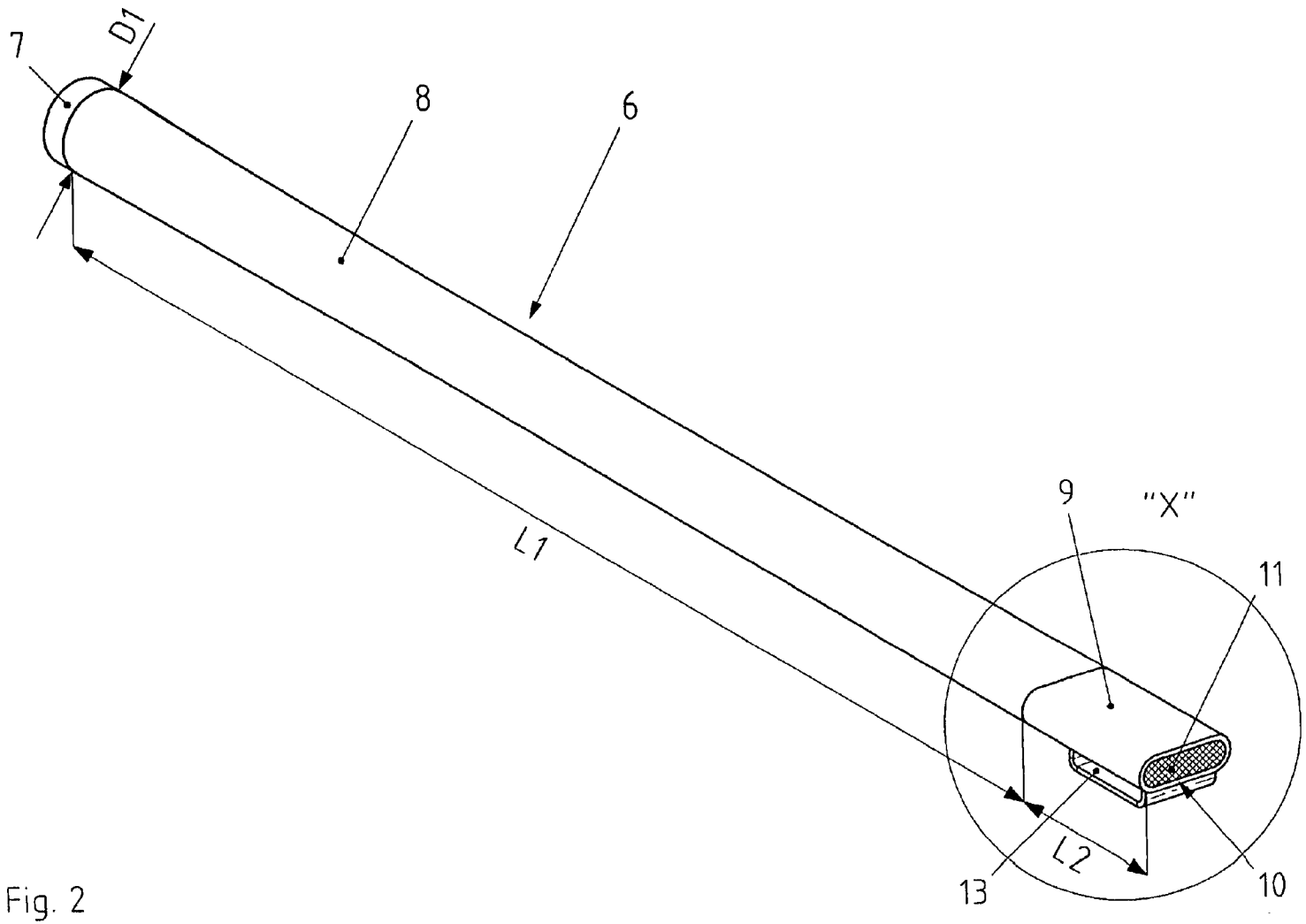
FIG. 2 is a perspective view of a first modification of the submerged pipe.
Figure 3:
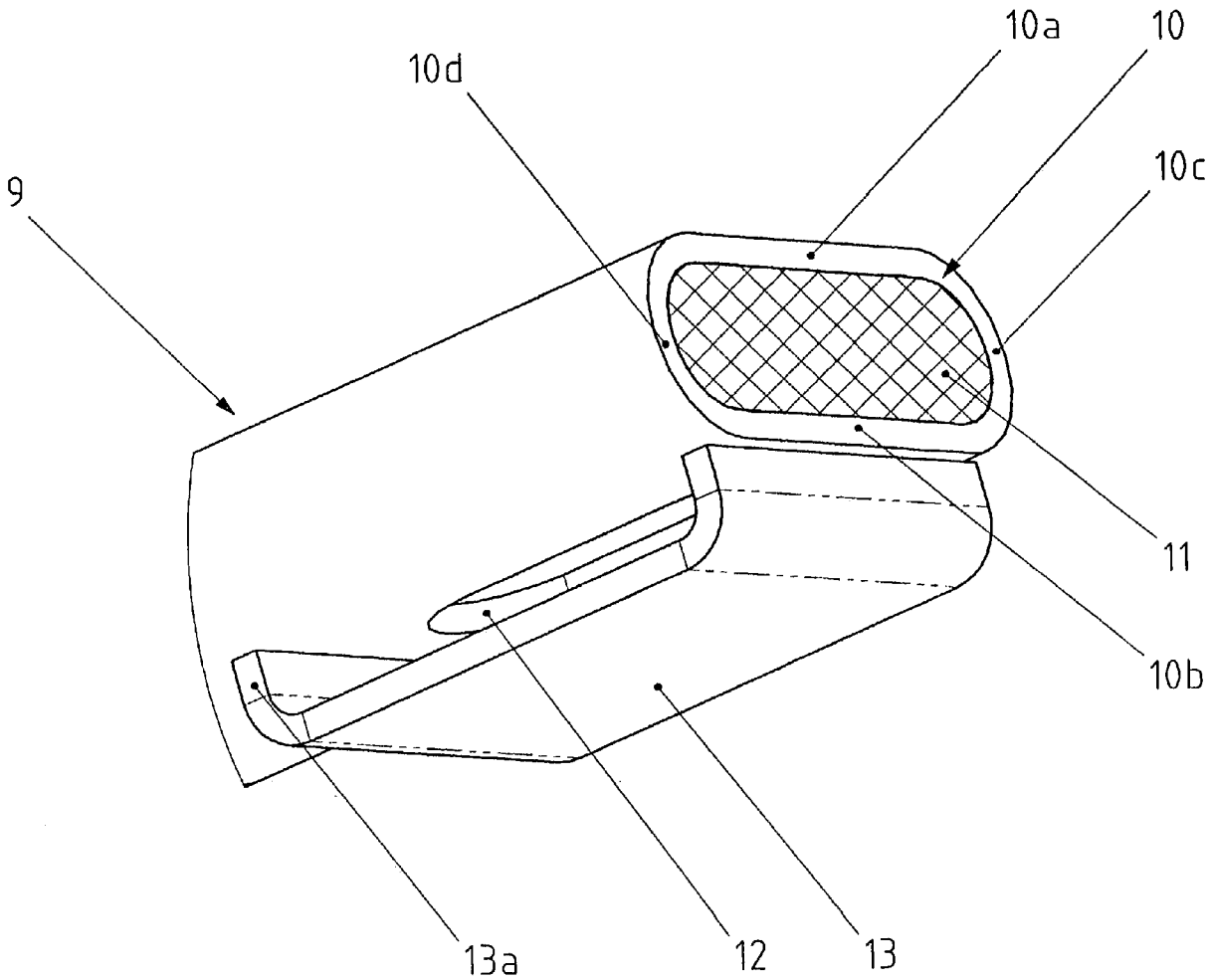
FIG. 3 is an enlarged view of the detail "X" in FIG. 2.
Figure 4:
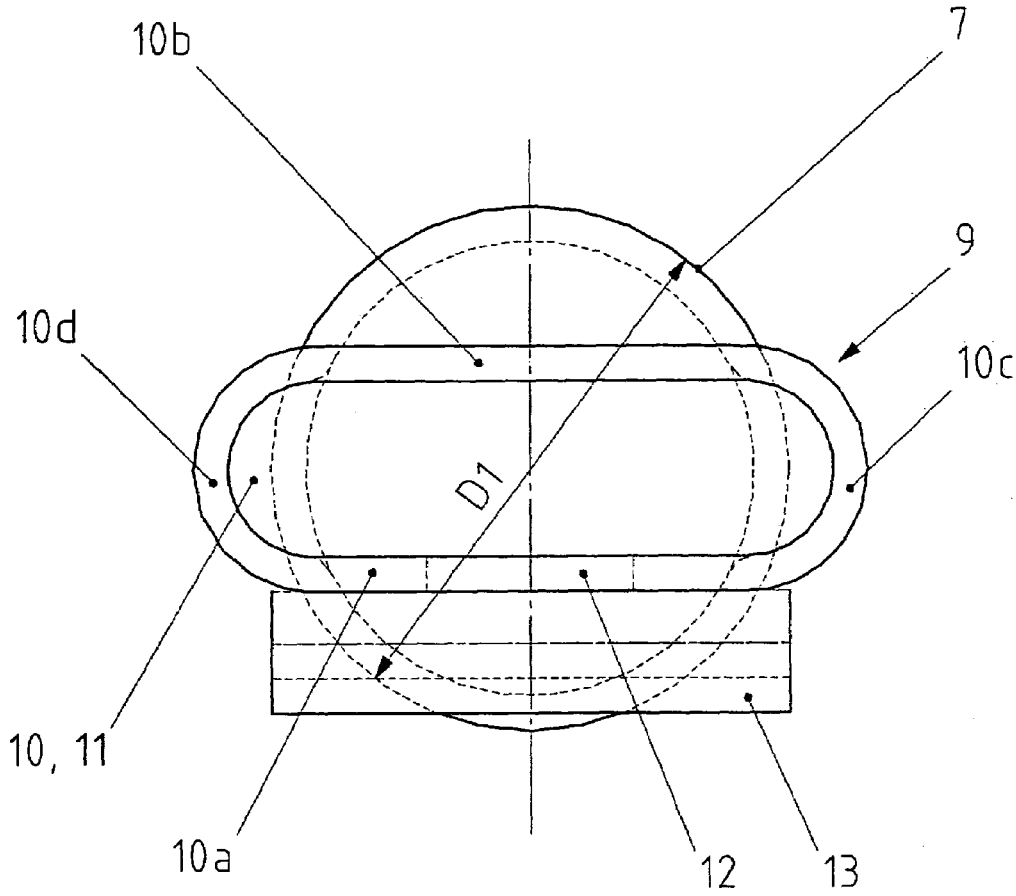
FIG. 4 is an enlarged front view of the submerged pipe according to FIG. 2.

FIG. 2 shows a first modification of the submerged pipe 6 as a separate component part in magnified form. The submerged pipe 6 has a cylindrical connecting piece 7 which is, seen in flow direction, followed by a gradually narrowing section 8 the diameter of which measured right at the beginning being D1 which is identical to that of the connecting piece 7. The section 8, the length of which being L1, is followed by the tip nozzle 9 of the submerged pipe the length of which being L2. The L1-to-L2 ratio is 8.3, for example. The connecting piece 7, the section 8 and the tip nozzle 9 of the submerged pipe are manufactured from a tubular pipe section made of heat-resistant material that is squeezed by means of a tool into a continuously flattening shape in the area where the section 8 and the tip nozzle 9 of the submerged pipe meet. At the beginning, the section 8 has a circular cross section D1 which, seen in flow direction, becomes more and more flat as being reformed in one plane so as to terminate in a pre-defined long-hole shape that emerges at the end of the tip nozzle 9 of the submerged pipe (cf. FIG. 4). Such re-forming produces a gradually narrowing, i.e. a change in cross section along with a reduction of cross-sectional area. The cross-sectional area as it measures at the end of the tip nozzle 9 of the submerged pipe is smaller by approx. one third than the cross-sectional area with diameter D1 at the beginning of the section 8. The long hole 10 as is formed at the end of the tip nozzle 9 of the submerged pipe is closed by a welded plug 11 or in any other convenient way. As can be clearly seen in FIG. 3, the long hole 10 is formed by two parallel wall sections 10*a*, 10*b* running straight on opposite sides and two semicircular wall sections 10*c*, 10*d*, where the distance between the two straight running wall sections 10*a*, 10*b* is at least one third of the diameter D1 in the section 8, in this example being approximately 10 mm.

In the even wall section 10*a* of the tip nozzle 9 of the submerged pipe that faces the mold bottom band 5 in operational state there is an oblong hole-type discharge opening 12 for the molten copper to flow out. Practical experiments have shown that it is advantageous for the cross sectional area of those openings to total preferably 90% or 98% of the cross section of flow as it measures at the end of the tip nozzle 9 of the submerged pipe. Instead of such a long hole 12 there can be two circular discharge openings 12*a*, 12*b* arranged right behind each other, as is shown in FIG. 7.

The discharge openings 12, 12*a*, 12*b* are "overlapped" by a parallel lip 13, where "overlapping" in this case means that the width of the lip 13 is equal or greater than the open width of the long hole 12, or greater than the diameter in case of circular discharge openings. In the modification according to FIG. 3, the lip 13, together with its spacers 13*a*, is welded to the tip nozzle 9 of the submerged pipe. The free space between the discharge opening 12 and the lip 13 should be 5 mm minimum.

Figures 5, 6:
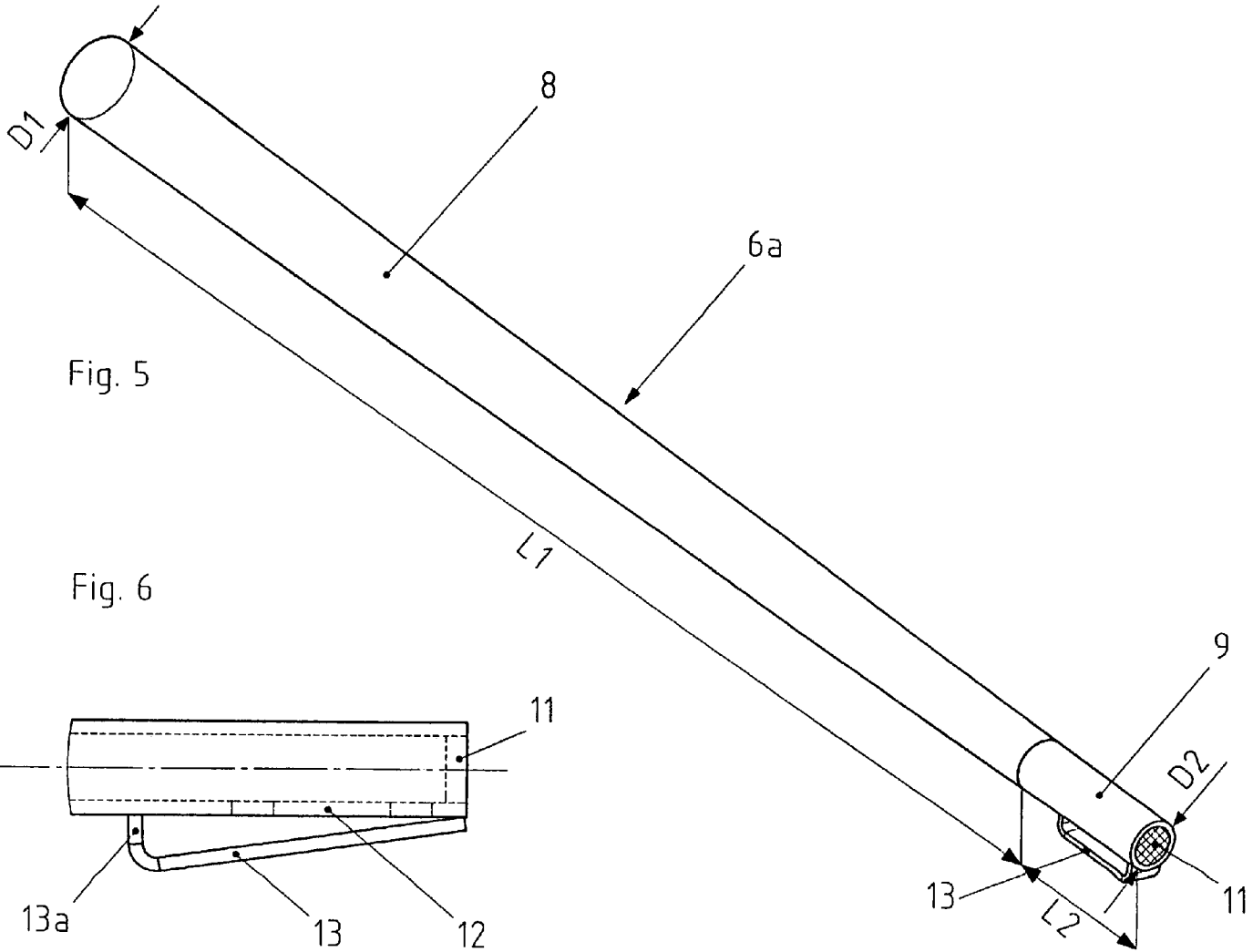
FIG. 5 is a perspective view of a second modification of the submerged pipe.
FIG. 6 is a longitudinal section of the tip nozzle of a submerged pipe according to the invention in inclined configuration.

FIG. 5 shows another modification of a submerged pipe 6*a*, in which the section 8 as well as the tip nozzle 9 of the submerged pipe are conically shaped over their entire length, starting with diameter D1 that is continuously reduced, by reducing the circular cross-sectional area, to diameter D2 at the end of the tip nozzle 9 of the submerged pipe. The circular opening of the tip nozzle 9 of the submerged pipe is sealed with the plug 11. The difference between the diameter D1 and diameter D2 is 45%. The discharge opening for the molten mass to flow out and the lip 13 are of the same design as used in the modification shown in FIG. 2. Compared with the submerged pipe as shown in FIG. 2 this one has no separate connecting piece. In the tip nozzle 9 of the submerged pipe shown in FIG. 6 the lip 13 overlapping the discharge opening 12 is provided in an inclined arrangement. Using a spacer 13*a*, the lip 13 being arranged in a distance of 5 mm to the wall of the submerged pipe's tip nozzle runs diagonally upwards up to the end of the submerged pipe's tip nozzle. The lip 13 is welded onto the submerged pipe's tip nozzle. For the rest, this tip nozzle is provided similar to the tip nozzle of the submerged pipe shown in FIG. 2.

Figure 7:
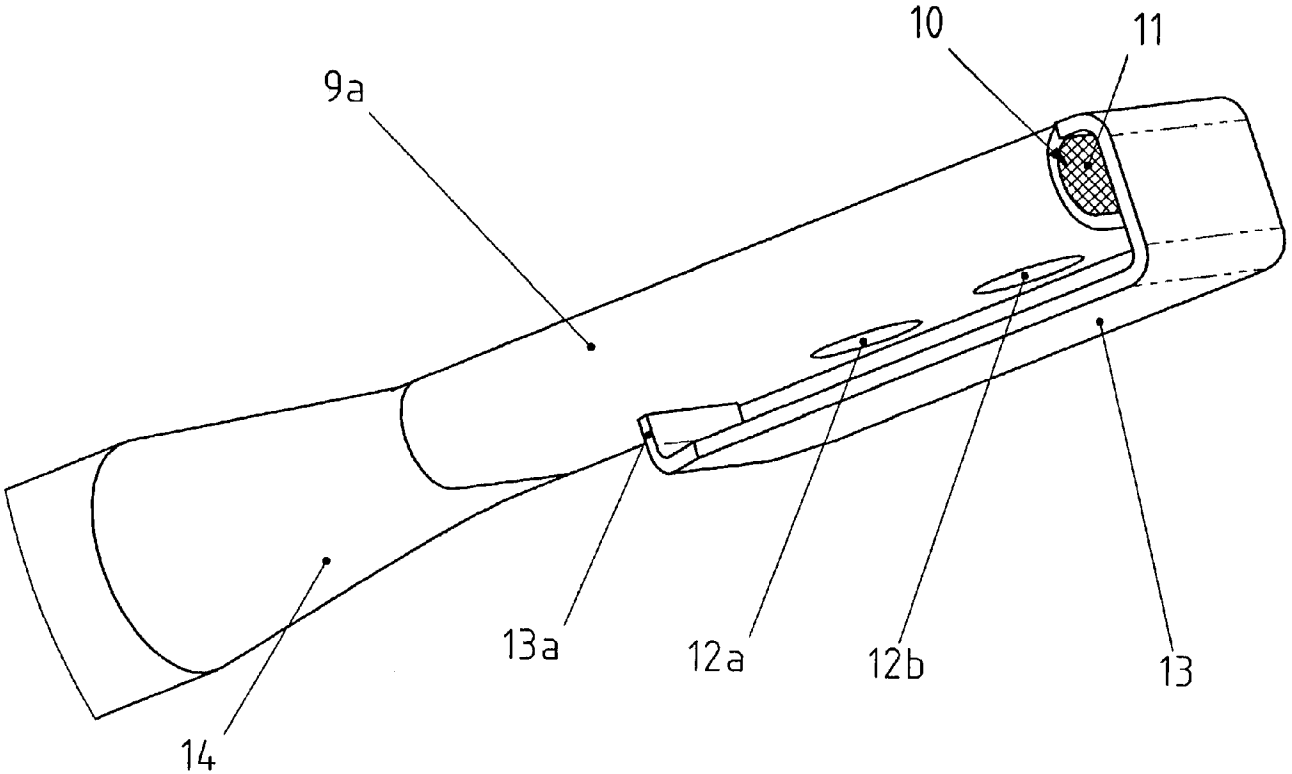
FIG. 7 is a perspective view of a tip nozzle of a submerged pipe with an integrally formed lip, forming a separate component part.

FIG. 7 shows a tip nozzle 9*a* of a submerged pipe in form of a separate component part that can be attached, and welded in place at the end of the conical section of a submerged pipe according to the modification as shown in FIG. 5. The tip nozzle 9 of the submerged pipe has a constant cross section in form of an oblong hole 10, the downstream end of which is sealed with a plug 11. On the opposite side, the tip nozzle 9*a* of the submerged pipe has a transition piece 14 to provide the change-over from the long-hole shape into the circular shape, exactly matching the appropriate section of the submerged pipe 6. At the bottom side of the tip nozzle 9*a* of the submerged pipe there are two discharge openings 12*a*, 12*b* arranged behind each other, overlapped by a parallel running lip 13, 13*a*. The lip 13 is integrally formed to the tip nozzle 9*a* of the submerged pipe that can be manufactured in the following way.

The far end of the submerged pipe, which in original state has a circular cross section, is re-formed be "squeezing flat" using a pressing tool in order to produce the desired cross section in form of a "long hole", with a short transition section 14 from the circular shape to the long-hole shape. Afterwards, a transverse cut is made in a distance from the pipe end that equals the length of the lip, without cutting the pipe in two parts, and a longitudinal cut extending as far as the gap made by the transverse cut. The tip of the pipe has now a lip running in longitudinal direction. After this is accomplished, the bore holes 12*a*, 12*b* are made for the discharge openings through which the molten mass can flow out. The long-hole 10 opening at the far end of the pipe tip is sealed by welding in a sealing cap 11, after which the protruding lip is bended towards the discharge openings so as to overlapping the discharge openings 12*a*, 12*b* in a pre-defined gap. The lip 13 is approx. 80 mm long, and its upstream facing end is welded to the neighboring wall section of the tip nozzle 9*a* of the submerged pipe.

In order to prevent the submerged pipes from deflecting under load in operating state, the pipes can be equipped with additionally stabilizing means such as, for example, one or more stiffening or reinforcing ribs.

The novel construction of the submerged pipes according to this invention very favorably influences the inclined stream of the molten copper as it runs downwardly from the tundish into the mold in practical applications. The stream of molten mass the flow rate of which is increased due to the inclined disposition of the submerged pipes twice undergoes a change of direction and, as a consequence, is slowed down so as to guarantee a gentle discharge into the mold bath.

The gradually narrowing, in particular in the section 8, where the changes to the cross section result in a reduced cross-sectional area, keeps the molten mass in contact with the submerged pipe's internal walls so as to not allow gas bubbles or other voids to emerge. This also applies to the tip nozzle 9 of the submerged pipe, 9*a*, owing to the changes made to the cross-sectional shape (circular/long hole) and the further tapering in this place. As the end of the tip nozzle 9, 9*a* of the submerged pipe is sealed off, the melt is forced to undergo a deflection of at least 90° which leads to a first reduction of flow rate.

It is important that the layout of the discharge opening(s) at the bottom side of the tip nozzle 9 of the submerged pipe causes the stream of molten mass to change its direction at least by 90°, and the layout of the lip 13 underneath the discharge openings as an additional means effects a second change, or lateral deflection of the stream of molten mass together with a further reduction of flow rate. The stream of molten mass is discharged evenly to either side of the lip 13 and runs, with its flow rate significantly reduced, underneath the bath level into the molten bath of the mold. In this way, the flow rate of the molten mass can be reduced to 0.5 meters per second or less so as to not being shot with high speed into the mold as is the case with conventional submerged pipes. This significantly reduces the formation of bubbles, and existing bubbles are allowed to escape at the side walls of the mold to the effect that formation of air or gas intrusions in the slab is avoided. In addition, the molten mass is prevented from unwanted discharging in deeper areas inside the mold. The stream of molten mass is discharged to a position right underneath the surface of the molten bath where it is allowed to degas so that an even, smooth surface can form when solidifying. There is no turbulences to occur in the molten mass in the bath's surface area. By discharging the molten mass in the mold bath in the way described above the risk of damaging the mold walls can also be ruled out.

Figure 8:
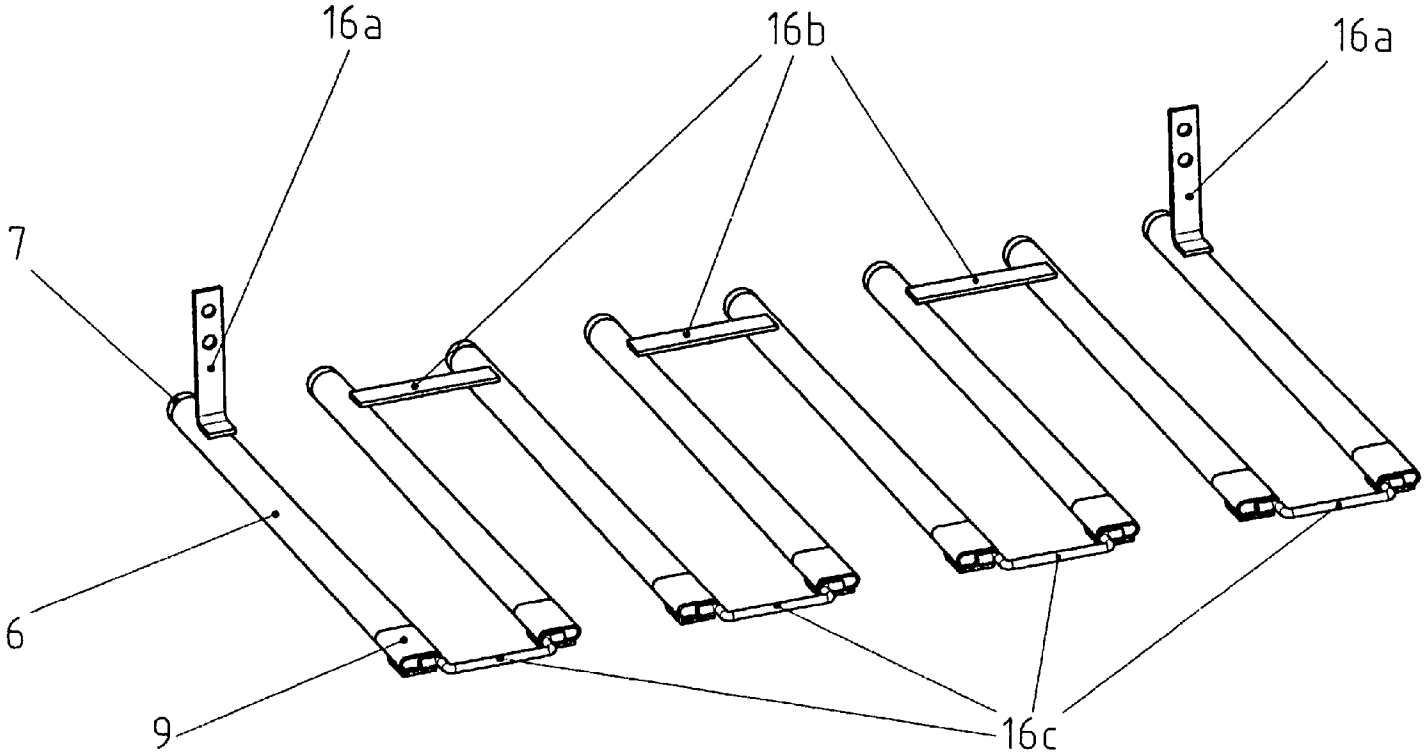
FIG. 8 is an isometric view of an assembly of several submerged pipes with electric resistance heating.

Referring now to FIG. 8, six submerged pipes 6 of the casting snout 2 have their cylindrical connection pieces 7 embedded in a block of fire-resistant concrete, which forms a part of the tundish 1. FIG. 8 illustrates the pipes without the concrete block. In the illustrated example, the assembly is provided with a resistance heating device. The first and last submerged pipes 6, in immediate vicinity of the connection pieces 7, are provided with connection terminals 16*a* of copper welded onto the pipe. The terminals 16*a* are utilized for the supply of electrical current. The following, or intermediate, submerged pipes 6 are connected via conductor bridges 16*b*, 16*c* of copper that are welded to the connection piece 7 and to the submerged pipe tip 9. This establishes a closed current circuit between the first and the last submerged pipes 6. The bridges 16*b* are formed of flat material and the bridges 16*c* are formed of rod or wire material. The submerged pipes 6 are heated to the necessary operating temperature prior to their immersion into the molten bath in the mold 3. Upon immersion into the melt, the bridges 16*c* at the tips of the submerged pipes melt and disintegrate.

This application claims the priority, under 35 U.S.C. §119, of European patent application No. 03 017 412.2, filed Aug. 1, 2003; the disclosure of the prior application is herewith incorporated by reference in its entirety.

We claim:

1. A casting system for pouring nonferrous metal melt, comprising:

a tundish;

at least one submerged pipe communicating with said tundish and extending at an incline with a pre-defined pouring angle towards and into a mold;

said submerged pipe having a first section and a second section defining a tip nozzle for submersion into a molten bath in said mold, whereby said tip nozzle is sealed off at a free end thereof, said second section having a wall facing a bottom side of said mold formed with at least one discharge opening and configured to effect a first change in a flow direction of a molten mass through said submerged pipe; and a lip disposed at said tip nozzle, overlapping said discharge opening at a pre-defined distance, and causing the molten mass to experience a second change in the flow direction and distribution transversely to a longitudinal axis of the mold, and said discharge opening together with said lip being located below a mold bath surface in an operating state thereof.

2. The casting system according to claim 1, wherein said lip runs parallel to said discharge opening.

3. The casting system according to claim 1, wherein said lip is inclined relative to said discharge opening.

4. The casting system according to claim 1, wherein said discharge opening is an oblong hole.

5. The casting system according to claim 1, wherein a cross-sectional area of said discharge opening amounts to between 80% and 98% of a cross-sectional area of said tip nozzle at an end thereof.

6. The casting system according to claim 1, wherein said at least one discharge opening is one of a plurality of discharge openings, and a total cross-sectional area of all of said discharge openings amounts to between 80% and 98% of a cross-sectional area of said tip nozzle at an end thereof.

7. The casting system according to claim 1, wherein a greatest distance between said discharge opening and said lip overlapping said discharge opening is no less than 5 mm.

8. The casting system according to claim 1, wherein said first section is a tapering section with gradually narrowing internal walls along the flow direction of the molten mass.

9. The casting system according to claim 8, wherein said tapering section has a circular cross section at an inflow beginning thereof, and a cross section with a shape of an oblong hole at an end thereof.

10. The casting system according to claim 1, wherein said first section has a conical shape.

11. The casting system according to claim 1, wherein said tip nozzle undergoes a further gradual narrowing in downstream direction.

12. The casting system according to claim 8, wherein said tip nozzle is formed as a separate component part attached to an end of said tapering section.

13. The casting system according to claim 1, wherein a length and a degree of tapering of said submerged pipe are matched as a function of said pouring angle, to set a flow rate of the molten mass, after flowing against said lip, not to exceed 0.5 meters per second.

14. The casting system according to claim 1, which further comprises a resistance heating device disposed to heat said submerged pipe.

15. The casting system according to claim 1, wherein said first section and said tip nozzle are made of mutually different refractory materials.

16. The casting system according to claim 1 configured for pouring copper or copper alloys.

* * * * *